United States Patent [19]

Weiss

[11] 4,014,508

[45] Mar. 29, 1977

[54] BOOK HOLDING DEVICE

[76] Inventor: Adelle Weiss, 214 Carol Ave., Pelham, N.Y. 10803

[22] Filed: Nov. 13, 1975

[21] Appl. No.: 631,511

[52] U.S. Cl. ..... 248/451; 40/10 R

[51] Int. Cl.[2] ..... A47B 97/04

[58] Field of Search ..... 40/10 R, 10 A, 10 B, 40/341; 248/441, 451–453, 445, 74 PB, 499

[56] References Cited

UNITED STATES PATENTS

| | | | |
|---|---|---|---|
| 833,683 | 10/1906 | Eberly | 40/10 R X |
| 1,601,463 | 9/1926 | White et al. | 248/451 |
| 1,699,853 | 1/1929 | Moran | 248/445 |
| 2,807,908 | 10/1957 | Lykes | 248/451 |
| 3,041,774 | 7/1962 | Walker | 248/451 |
| 3,338,629 | 8/1967 | Drees | 248/451 X |
| 3,802,654 | 4/1974 | Jenko et al. | 248/74 PB X |
| 3,894,709 | 7/1975 | Weir | 248/445 |

FOREIGN PATENTS OR APPLICATIONS

| | | | |
|---|---|---|---|
| 167,221 | 11/1950 | Austria | 248/451 |
| 339,944 | 12/1930 | United Kingdom | 248/441 C |

*Primary Examiner*—Lawrence J. Staab
*Attorney, Agent, or Firm*—Shenier & O'Connor

[57] ABSTRACT

A book holding device comprises a pair of rigid elongated page-retaining members secured to a book-supporting board by a pair of elastic cords which extend across the back of the board. Means are provided for restricting the horizontal movement of the cords beyond predetermined limits.

6 Claims, 7 Drawing Figures

Fig 1
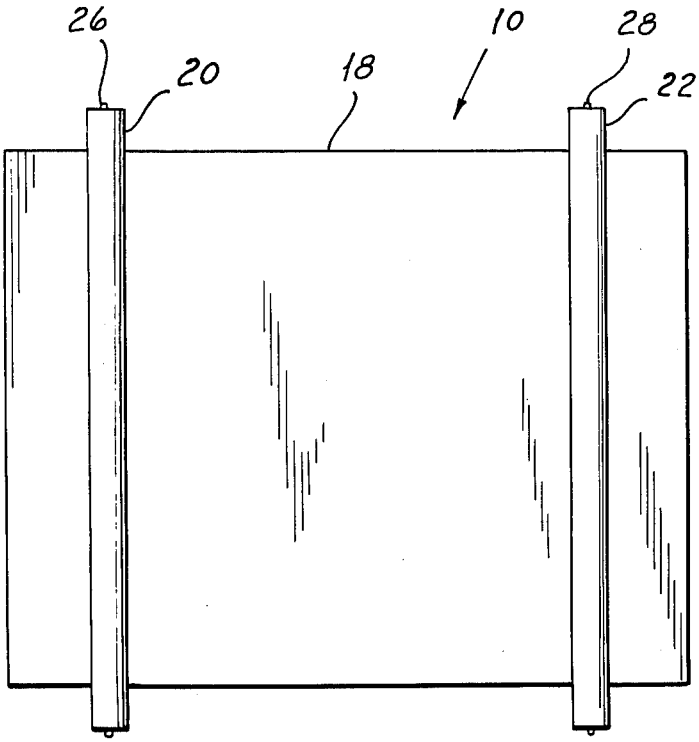
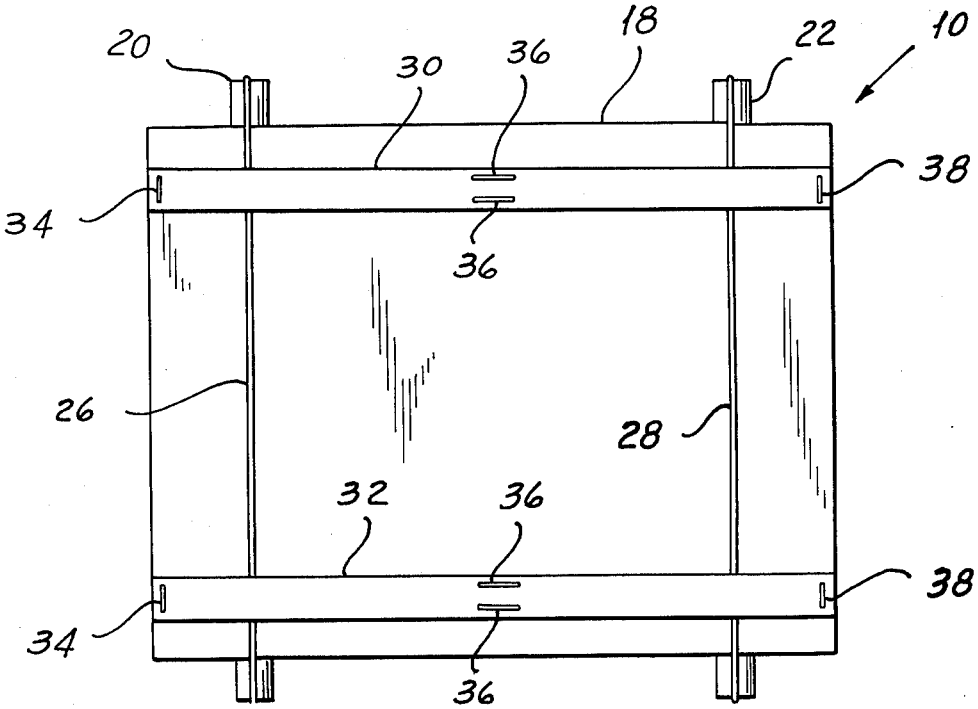
Fig 2

Fig 6
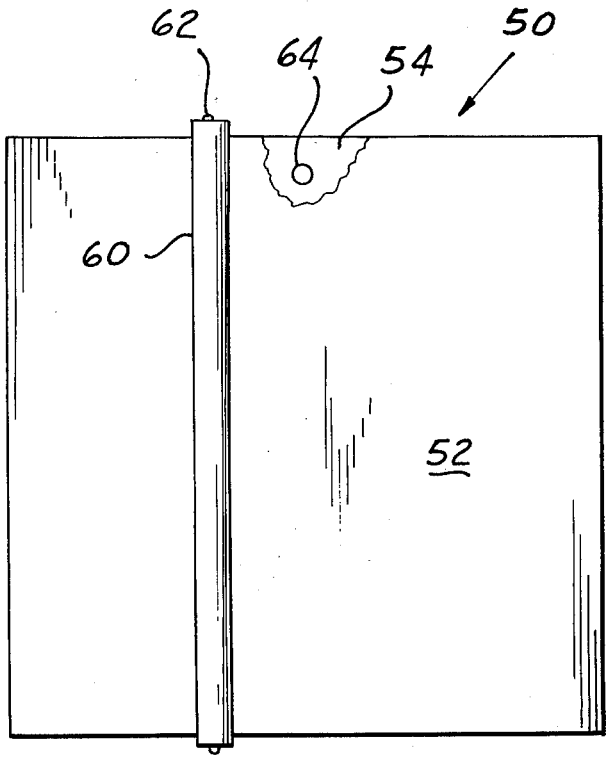
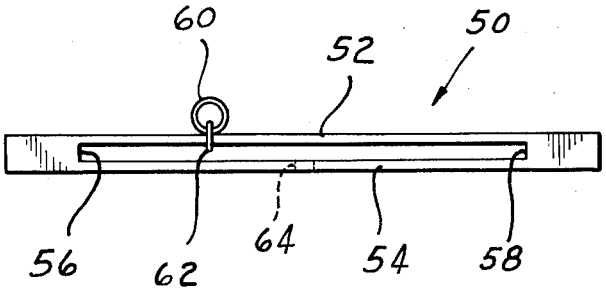
Fig 7

BOOK HOLDING DEVICE

BACKGROUND OF THE INVENTION

This invention relates to a device for holding down sheet material such as books, magazines, and the like.

Often it is desirable to read or refer to a page of a book while having the hands free for writing, cooking, building, or some other activity. Devices for holding down book pages are known in the prior art. These devices, however, are often mechanically complex and unadaptable to books of varying sizes. Devices which employ elastic strings and the like to hold down book pages apply all of the holddown pressure along a narrow portion of the page, possibly causing damage to fragile originals, particularly at the extremes of the line of contact.

SUMMARY OF THE INVENTION

One object of my invention is to provide a book holder which is mechanically simple.

A second object of my invention is to provide a book holder which is readily adaptable to books of varying sizes.

A third object of my invention is to provide a book holder which applies pressure over a broad area of contact.

Other and further objects of my invention will appear from the following description.

In general, my invention contemplates a book holding device comprising a board for supporting a book and a pair of preferably rigid, tubular, elongated retaining members for retaining the respective left and right hand halves of the book against the board. The retaining members are elastically secured to the board by a pair of elastic cords extending across the rear face of the board between the ends of the retaining members, the cords being restricted in their horizontal movement across the rear face of the board either by tapes or the like or by a second board spaced behind the first board to form a channel.

In use, the retaining members are urged against the respective book halves by the elastic cords to contact said book halves over a relatively broad surface area. As a result, minimal pressure is applied to the exposed book pages for a given hold-down force, thereby minimizing the possibility of book injury. The retaining members are readily employed with books of varying sizes and page widths by sliding the cords across the underside of the baseboard to suitable positions. The mechanical simplicity of the above-described structure is apparent from its description.

BRIEF DESCRIPTION OF THE DRAWINGS

In the accompanying drawings which form part of the instant specification and which are to be read in conjunction therewith and in which like reference numerals are used to indicate like parts in the various views:

FIG. 1 is a top plan of one embodiment of my book holding device.

FIG. 2 is a bottom plan of the embodiment shown in FIG. 1.

FIG. 6 is a top plan of another alternative embodiment of my invention, designed to hold memos and the like.

FIG. 7 is an end elevation of the embodiment shown in FIG. 6.

DETAILED DESCRIPTION OF THE INVENTION

Figure 3:
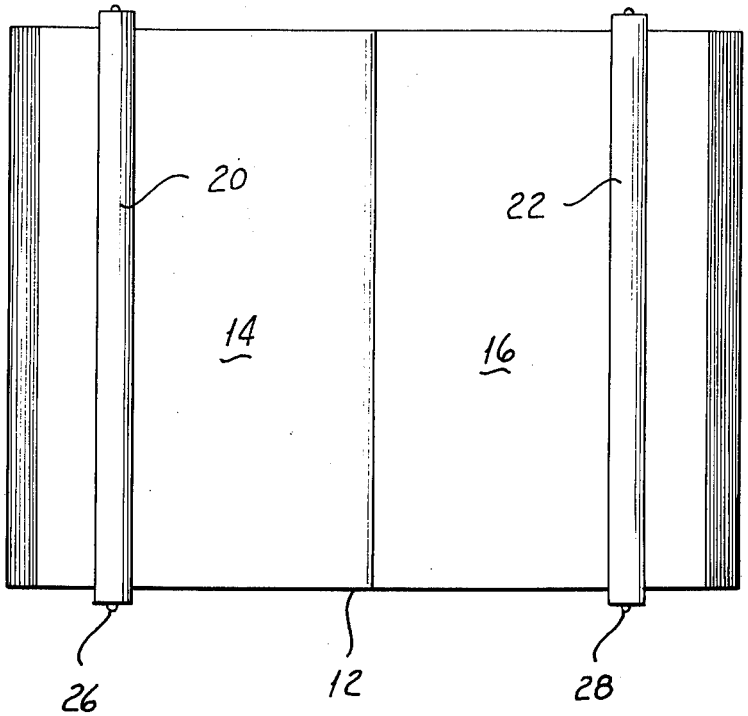
FIG. 3 is a top plan of the embodiment shown in FIG. 1, with a book in place.
Figure 4:
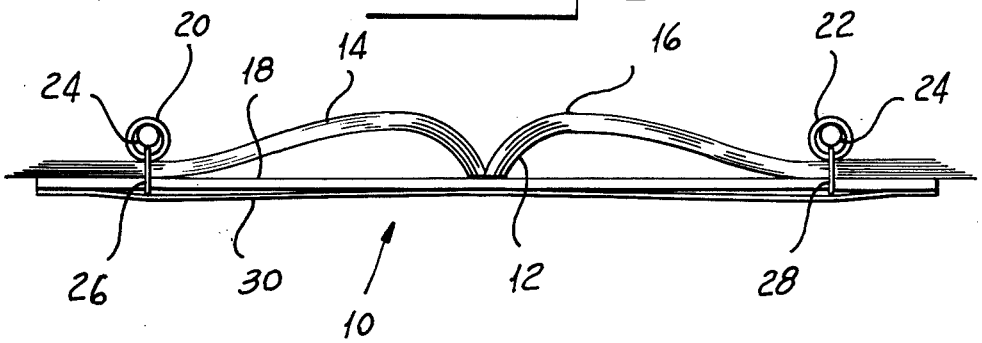
FIG. 4 is an end elevation of the embodiment shown in FIG. 1, with a book in place.

Referring now to FIGS. 1 to 4, my book-holding device, indicated generally by the reference character 10, is intended to be used with books such as the book 12 shown in FIGS. 3 and 4. The device 10 includes a rectangular board 18 for supporting the book 12, the board 18 having a front face 17 and a rear face 19. The book 12 is held open to the desired place by means of a pair of tubular members 20 and 22 which are placed against the left and right hand pages 14 and 16, respectively, of the book 12. I have found that the cylindrical shape of members 20 and 22 permits quicker gripping action as contrasted with other non-cylindrical shapes. The members 20 and 22 are elastically secured to the board 18 by means of respective elastic cords 26 and 28. Each of the cords 26 and 28 extends across the rear face 19 of the board 18 between the ends of the tubular member 20 or 22, to which it is secured. Preferably, each of the cords 26 and 28 is secured to the respective tubular member by threading the cord through the corresponding member and securing the cord by inserting a cylindrical rod 24 into the tubular member to wedge the cord against the member's inner surface. The rods 24 also give the tubular members 26 and 28 a desirable degree of rigidity.

The cords 26 and 28 are restricted in their horizontal movement across the rear face 19 of the board 18 by means of a pair of strips 30 and 32 which are disposed horizontally across the rear face 19 at vertically spaced locations. "Vertical" and "horizontal" are defined here with reference to the pages of the book. Strips 30 and 32, formed from fabric or other suitable material, are secured to the respective ends of the board 18 by fasteners such as staples 34 and 38. Preferably, the strips 30 and 32 are also secured to the middle of the board by means of center fasteners 36.

The method of use of my invention should be apparent from the foregoing description. The book 12 is placed upon the front face 19 of the board 18 and is held open at the desired point by slipping the tubular members 20 and 22 over the left-hand and right-hand pages 14 and 16, respectively. If desired, a group of pages may be left free in the center to facilitate page turning. The tubular members 20 and 22 are readily slidable horizontally across the board 18 to accommodate books of varying sizes.

Figure 5:
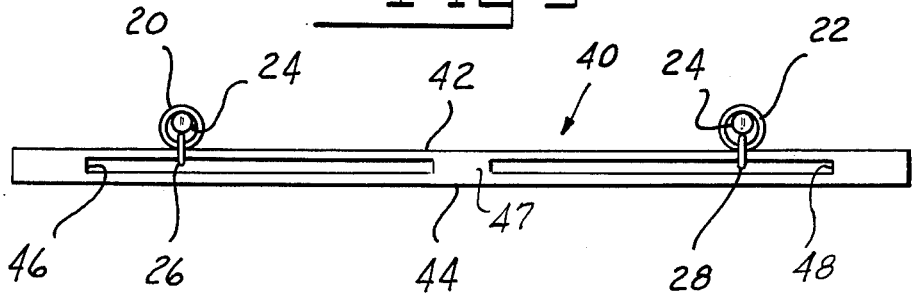
FIG. 5 is an end elevation of an alternative embodiment of my invention.

Referring now to FIG. 5, I show a modified form of my invention in which a parallel-spaced rear board 44 is substituted for the tapes 30 and 32. More particularly, the board 40 of my alternative embodiment comprises a front board 42 and a rear board 44 which are spaced in a parallel manner by respective left and right wall portions 46 and 48 to form a channel through which the cords 26 and 28 are passed. The embodiment shown in FIG. 5 is used in a manner identical to that of the embodiment shown in FIGS. 1–4. I include a center stop 47 in the channel in this form of my invention.

In FIGS. 6 and 7, I show a retaining device which is similar to that shown in FIG. 5, but which is provided with only one tubular member and is designed to retain single flat sheets such as memos and the like. The device includes a base 50 comprising a front board 52 and a rear board 54 which are joined by side wall portions 56 and 58 to form a cord-receiving channel. A single tubular member 60 is elastically secured to the base 50 by means of an elastic cord 62 extending through the channel between the ends of the tubular member 60. The base 50 is provided with a hole 64 near one end of the channel to facilitate mounting on a wall or the like. Alternatively, the rear board 54 may be provided with a hole (not shown) near the side of the channel intermediate the ends thereof to permit mounting with the member 60 in a horizontal attitude.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A book holding device, which comprises:

a. a board for supporting said book, said board having a front face and a rear face;

b. a pair of elongated relatively inflexible retaining members for retaining the respective left-hand and right-hand halves of said book against the front face of said board;

c. a pair of elastic cords for elastically securing said retaining members to said board, each of said elastic cords extending across the rear face of said board between the ends of one of said members; and d. means located on said rear face of said board forming a pair of channels for respectively receiving and substantially enclosing a portion of said elastic cords for horizontal sliding movement between inner limits adjacent to the vertical centerline of said board and outer limits adjacent to and spaced from the outer periphery of said board.

2. A device as in claim 1 in which said restricting means comprises a pair of vertically spaced horizontal strips extending across the rear face of said board, said strips being secured at their ends to said board, said elastic cords being threaded between said strips and said rear face.

3. A device as in claim 1 in which said restricting means comprises means for forming vertical channels in said board, said elastic cords being threaded through said channels.

4. A device as in claim 1 in which said retaining members are cylindrically shaped.

5. Apparatus for retaining sheet material, which comprises:

a. a rectangular board having a front face and a rear face and having a channel formed therein extending between a pair of oppositely disposed edges;

b. an elongated relatively inflexible retaining member for retaining said sheet material against the front face of said board;

c. an elastic cord for elastically securing said retaining member to said board, said channel receiving and substantially enclosing a portion of said elastic cord for transverse sliding movement within predetermined limits adjacent to and spaced from said edges and restricting the movement of said cord beyond said predetermined limits, said channel being free of obstructions between said limits.

6. A device as in claim 5 in which said retaining member is cylindrically shaped.

* * * * *